US012161177B2

(12) United States Patent
Liu

(10) Patent No.: US 12,161,177 B2
(45) Date of Patent: Dec. 10, 2024

(54) FLEXIBLE MASK WITH ADJUSTABLE STRAP

(71) Applicant: Ningbo Troika Science & Technology Company Limited, Ningbo (CN)

(72) Inventor: Wengao Liu, Ningbo (CN)

(73) Assignee: Ningbo Troika Science & Technology Company Limited, Ningbo (CN)

( * ) Notice: Subject to any disclaimer, the term of this patent is extended or adjusted under 35 U.S.C. 154(b) by 375 days.

(21) Appl. No.: 17/070,570

(22) Filed: Oct. 14, 2020

(65) Prior Publication Data

US 2021/0401085 A1 Dec. 30, 2021

Related U.S. Application Data

(60) Provisional application No. 63/044,526, filed on Jun. 26, 2020.

(51) Int. Cl.
*A41D 13/11* (2006.01)

(52) U.S. Cl.
CPC ..... *A41D 13/1161* (2013.01)

(58) Field of Classification Search
CPC . A41D 13/11; A41D 13/1115; A41D 13/1161; A62B 18/084; A62B 18/02; A62B 18/025; A62B 23/02; A62B 23/025
See application file for complete search history.

(56) References Cited

U.S. PATENT DOCUMENTS

| | | | | |
|---|---|---|---|---|
| 11,577,102 | B2 * | 2/2023 | Seela | A62B 18/025 |
| 2003/0217751 | A1 * | 11/2003 | Patrick | A62B 18/084 128/205.27 |
| 2006/0283454 | A1 | 12/2006 | Delaney et al. | |
| 2010/0313890 | A1 * | 12/2010 | Messier | A61L 9/16 128/206.19 |
| 2011/0271955 | A1 | 11/2011 | Palomo et al. | |
| 2012/0318273 | A1 * | 12/2012 | Tsuei | A41D 13/1115 156/204 |
| 2015/0306432 | A1 * | 10/2015 | Orofino | A62B 18/025 29/505 |
| 2016/0151650 | A1 * | 6/2016 | Reese | A41D 13/1161 128/863 |

(Continued)

FOREIGN PATENT DOCUMENTS

| | | | | |
|---|---|---|---|---|
| CN | 106037088 A | * | 10/2016 | A41D 13/1107 |
| DE | 202011108310 U1 | | 1/2012 | |

(Continued)

*Primary Examiner* — Aiying Zhao
(74) *Attorney, Agent, or Firm* — Dickinson Wright PLLC

(57) ABSTRACT

A facial covering in the form of a mask for covering the nose and mouth of a user is provided. The mask is flexible and includes side edges. The mask defines a pair of channels on opposing side edges. An adjustable strap extends through the channels. An upper portion of the strap extends between the upper ends of the channels and a lower portion of the strap extends between the lower ends of the channels. The strap is shiftable relative to the channels, such that adjustment of the length of the upper portion adjusts the length of the lower portion. A clip mechanism may be disposed on the upper and/or lower portion to set the effective length of the strap. Bendable nose, chin, and/or cheek strips may be disposed along the side edges. The channels may be reinforced.

17 Claims, 5 Drawing Sheets

(56) References Cited

U.S. PATENT DOCUMENTS

| | | | | |
|---|---|---|---|---|
| 2019/0174845 | A1* | 6/2019 | Cheng | A41D 13/1115 |
| 2021/0329987 | A1* | 10/2021 | Austin | A62B 23/025 |
| 2021/0329994 | A1* | 10/2021 | Sun | A41D 31/02 |

FOREIGN PATENT DOCUMENTS

| | | | | | |
|---|---|---|---|---|---|
| GB | 840190 | A | * | 7/1960 | A41D 13/11 |
| GB | 1475675 | A | * | 6/1977 | A41D 13/1115 |
| JP | 2013188281 | A | | 9/2013 | |
| KR | 20080026347 | A | * | 3/2008 | A41D 13/1115 |
| WO | 2011025094 | A1 | | 3/2011 | |

* cited by examiner

FLEXIBLE MASK WITH ADJUSTABLE STRAP

CROSS-REFERENCE TO RELATED APPLICATIONS

This application claims the benefit of previously filed U.S. Provisional Patent Application No. 63/044,526, filed Jun. 26, 2020, the entire content of which is hereby incorporated by reference in its entirety.

FIELD OF THE DISCLOSURE

The present disclosure relates generally to face coverings. More particularly, the present disclosure relates to flexible masks with adjustable straps.

BACKGROUND OF THE DISCLOSURE

This section provides a general summary of background information and the comments and examples provided in this section are not necessarily prior art to the present disclosure.

Face coverings, such as masks that cover the mouth and nose to limit respiratory exposure are in common use throughout the world for a variety of purposes. For example, medical workers commonly use masks to protect themselves from various viruses and bacteria carried by patients, as well as protecting patients from viruses and bacteria that may be associated with the medical worker.

Similarly, construction workers, painters, and the like often wear masks to protect against dust, debris, harmful gases, and the like.

Different mask types may be provided depending on the desired or optimal level of protection. For example, some masks may be constructed of a substantially rigid shape with a sealing gasket around the perimeter that is pressed against the face of the user to isolate the nose and mouth from the surrounding environment. Breathability may be provided by filter cartridges, valves, or the like. Breathability may also be provided directly through the material of the mask if the mask is made of a woven material having microscopic openings therethrough that are designed to trap particles but allow sufficient airflow for breathing. However, it can be difficult in such instances to find a comfortable fit for a rigid mask, or such mask may not conform to the shape of a user's face.

Other mask types may be flexible, such as if constructed from cotton or fabric or other woven or spun materials. Such masks may be pulled across the face of the user. These types of masks may be more comfortable around the user's face, but can be difficult to provide a shape and fit that generally stays in contact around its perimeter with the user's face, which can decrease the effectiveness of the mask. It can be undesirable for air to enter or exit the space between the mask and the user's face without passing through the filtering material of the mask. For example, air that exits or enters out the sides of the mask and that bypasses the mask material does not benefit from the purpose of the mask.

In the case of flexible masks, such masks may include an attachment mechanism for holding the mask to the user's face. For example, an elastic loop may extend from each side of the mask that is designed to extend behind a user's ear to hold the mask against the user's face. However, these elastic loops can be uncomfortable on the back of the user's ear as the elastic material stretches and exerts a force on the back of the user's ear in response to the mask being pulled against the face and stretching the elastic loop.

Another attachment mechanism may be in the form of individual straps attached to each corner of the mask. The lower straps may be tied together at the base of the neck, with the upper straps tied together at the back of the head. While this method may be more comfortable than the elastic loops pulling on the ears, the attachment method can be substantially cumbersome, requiring two knots to be made by the user behind their head. Moreover, upon tying one knot, tying the second knot may make the first knot uncomfortable, requiring adjustment of the first knot, resulting in a repetitive and iterative process that can lead to frustration and a possible loose attachment.

Due to public health concerns around the world, mask wearing has become far more prevalent, with the public preferring to wear masks when outside their home or in some cases required to wear masks to use public accommodations or in the course of their employment. Accordingly, increased production and use of masks is occurring.

Thus, there exists an increased need for comfortable and sufficiently fitting masks that can be attached and removed easily from a user's face.

SUMMARY

According to an aspect, a facial covering arranged to be placed over a user's nose and mouth is provided. The facial covering includes: a flexible panel having upper, lower, right, and left sides; a pair of channels defined on opposite edges, the channels being open at opposing ends thereof and defining a continuous passageway therebetween; at least one adjustable strap extending through the channels; wherein the at least one adjustable strap is moveable through the channels.

In one aspect, the opposite edges are left and right side edges. In another aspect, the opposite edges and upper and lower edges. In one aspect the at least one strap is a single strap. In another aspect, the at least one strap is a pair of separate straps.

In one aspect, the at least one adjustable strap includes a clip mechanism that is adjustable along the at least one adjustable strap to adjust a first length of a looped portion that defines a closed loop and to adjust a second length of a tail portion that defines a closed loop having a first length, and the tail portion defines a second length, wherein, in response to movement of the clip mechanism, the first length increases when the second length decreases and the second length increases when the first length decreases.

In one aspect, the at least one adjustable strap comprises a single strap extending through both channels and moveable through the channels, wherein the strap defines a lower portion extending between the lower ends of the channels, an upper portion extending between the upper ends of the channels, and captured portions within the channels, wherein adjustment of an exposed length of one of the upper portion and the lower portion automatically causes adjustment of an exposed length of the other of the upper portion and the lower portion.

In one aspect, at least one of the upper portion or the lower portion includes the looped portion and the tail portion.

In one aspect, the edges are top and bottom edges, and the at least one strap includes an upper strap and lower straps extending respectively through the channels at the top and bottom edges, and the upper and lower straps are adjustable independent of each other.

In one aspect, the at least one strap comprises a left strap and a right strap, wherein the left strap extends through the channel on the left side and the right strap extends through the channel on the right side, wherein adjustment of the strap on the left side is independent of adjustment of the strap on the right side.

In one aspect, the facial covering includes a plastically deformable nose strip portion embedded within the upper portion of the panel and a plastically deformable chin strip portion embedded within the lower portion of the panel.

In one aspect, the mask has a rectangular shape or a non-rectangular shape.

In one aspect, the channels extend substantially fully along the opposite edges of the panel.

In one aspect, the channels are reinforced to improve sealing therealong.

In one aspect, a length of the edges of the panel are reduceable via bunching of the channel along the at least one adjustable strap while maintaining the length of the adjustable strap.

In one aspect, the facial covering includes a nose strip portion embedded within the upper portion of the panel without a chin strip portion at the lower end.

In one aspect, the facial covering includes cheek strips disposed on the sides of the panel.

In one aspect, the adjustable strap is shiftable through both channels.

In one aspect, the adjustable strap forms a closed loop extending through both channels and being exposed across the upper portion and lower portion.

In one aspect, adjustment of an exposed length of one of the upper portion and the lower portion automatically causes adjustment of the exposed length of the other of the upper portion and the lower portion.

In another aspect, a method of securing a facial covering over a nose and mouth is provided. The method includes: providing a panel of the facial covering, wherein the panel includes a pair of channels on opposite edges thereof; placing the panel over the face of the user in a first position on the user's face; adjusting an adjustable strap of the facial covering, wherein the adjustable strap extends through a pair of channels defined on opposite edges of the panel and defines a first portion that is exposed from the channels and a second portion that is exposed from the channels, and a captured portion disposed within the channels that connects the first portion and the second portion, wherein the adjustable strap is moveable and shiftable through the channels; adjusting the first portion of a strap to reduce an effective length of the first portion of the strap; in response to adjusting the upper portion of the strap, shifting the strap within the channels; in response to shifting the strap within the channels, correspondingly adjusting the second portion of the strap automatically while the facial covering remains substantially in the first position.

In one aspect, the method includes sliding a clip mechanism along the first or second portion to set the effective length of the adjustable strap.

In one aspect, the method includes bending and setting a nose strip portion embedded within an upper edge of the panel to correspond to a shape of the user's nose and bending and setting a chin strip portion embedded within a lower edge of the panel to correspond to a shape of the user's chin.

In one aspect, the channels are reinforced to improve sealing therealong.

In one aspect, the mask has a rectangular or non-rectangular shape.

In another aspect, a facial covering arranged to be placed over a user's nose and mouth is provided. The facial covering includes: a flexible panel having a pair of channels defined on opposite first and second side edges of the panel; at least one strap extending from the panel and arranged to attach to a user's head and/or neck; and a bendable strip disposed along each of the channels, the bendable strip sized and arranged to be adjustably bent to conform to the shape of a user's face.

In one aspect, the at least one strap is adjustable and moveable through the channels.

In one aspect, the facial covering includes a bendable nose strip disposed on the upper side of the panel and a bendable chin strip disposed on the lower side of the panel.

In one aspect, the at least one strap includes a looped portion and a tail portion and an adjustable clip slidable along the at least one adjustable strap to alter the relative lengths of the looped portion and the tail portion.

In one aspect, the at least one strap includes a first strap and second strap, wherein the first and second strap each include opposite ends fixedly attached to the panel.

In one aspect, the channels are reinforced by the panel material.

In one aspect, the at least one strap comprises a single strap that extends through both channels and defines a first portion, a second portion, and captured portions, wherein the captured portions are disposed within the channels, wherein adjustment of the first portion causes movement and shifting of the single strap through the In one aspect, the flexible panel is rectangular or non-rectangular.

BRIEF DESCRIPTION OF THE DRAWINGS

The drawings described herein are for illustrative purposes only of selected aspects and not all possible implementations, and are not intended to limit the scope of the present disclosure.

DETAILED DESCRIPTION OF THE DISCLOSURE

Example aspects of a flexible mask with an adjustable strap will now be more fully described. Each of these example aspects are provided so that this disclosure is thorough and fully conveys the scope of the inventive concepts, features and advantages to those skilled in the art. To this end, numerous specific details are set forth such as examples of specific components and methods associated with the mask to provide a thorough understanding of each of the aspects associated with the present disclosure. However, as will be apparent to those skilled in the art, not all specific details described herein need to be employed, the example aspects may be embodied in many different forms, and thus should not be construed or interpreted to limit the scope of the disclosure. According to an aspect, the mask may be employed as a surgical mask. However, according to another aspect, the mask may be utilized in a variety of other suitable applications, including general recreational use and in other professions.

Figure 1:
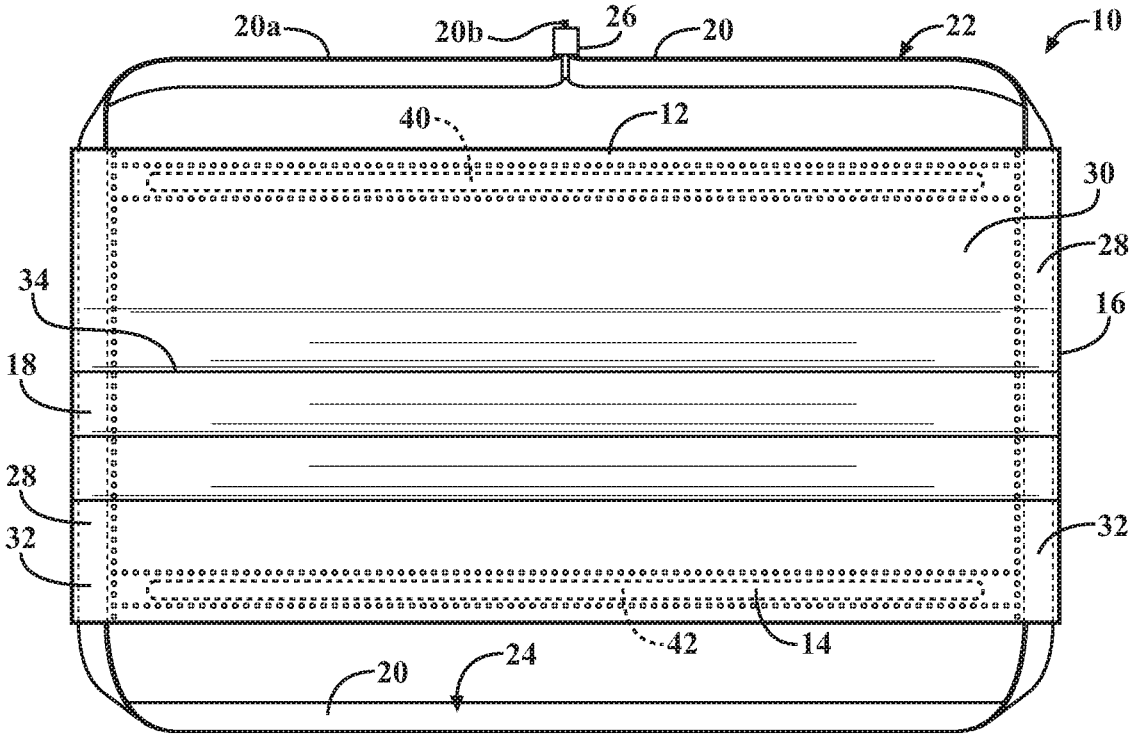
FIG. 1 illustrates a first side of a flexible mask with an adjustable strap having an upper portion and a lower portion and clip mechanism disposed on the upper portion according to an aspect of the disclosure.

FIG. 1 illustrates a facial covering, hereinafter referred to as mask 10, in a flat configuration. Mask 10 may have a generally flexible rectangular shape, including an upper edge 12, lower edge 14, right edge 16, and left edge 18. However, it will be appreciated that other shapes may be used that are not rectangular. Reference to the upper edge, lower edge, etc. may also refer to corresponding portions or edges, even for non-rectangular shapes. The edges 12-18 are generally arranged to form the illustrated rectangular shape when the mask 10 is flat. When worn by a user, the mask 10 may flex, such that the edges 12-18 become curved around the features of the user's face. For example, the upper edge 12 may flex around the user's nose, and the lower edge 14 may flex around the user's chin, with the right and left edges 14 and 16 flexing or curving along a user's cheeks. It will be appreciated that the reference to the shape of the mask 10 being rectangular may include other variations in shape from a pure rectangle, and that other four sided structures resembling a square or rectangle may also satisfy this description.

As mentioned above, in another aspect, the mask 10 may have another shape that is non-rectangular. For example, the mask 10 may have a circular shape, ovular shape, other polygonal shape, or the like. It will be appreciated that such shapes may have upper, lower, and side portions, similar to the above described edges, even if such shapes do not have distinct edges similar to the illustrated rectangle. For purposes of the discussion reference will be made to the illustrated rectangle, but it will be appreciated that such references may also apply to other shapes.

As shown in FIG. 1, mask 10 further includes an attachment mechanism 20, hereinafter referred to as strap 20. Strap 20 is shown extending outwardly from the lower edge 14 and upwardly from the upper edge 12. Strap 20 accordingly forms an upper portion 22 and a lower portion 24. The upper portion 22 and lower portion 24 may be part of a single loop or material or a plurality of fixedly joined sections or portions that create a closed loop.

Strap 20 may be made of a generally flexible material such as an elastic material configured to stretch in response to tension and configured to maintain pressure against a user's head when stretched during wearing of the mask 10. In another aspect, strap 20 may have a generally fixed length, meaning that the strap may be made from a non-elastic material, such that the strap 20 has a generally fixed length in response to tension on the strap during wearing of the mask 10. It will be appreciated that the non-elastic composition of the strap 20 may still stretch a limited distance when under tension.

The strap 20 may have a nominal length, being the length of the strap 20 when the strap 20 is not in tension. The nominal length of the strap 20 may be adjustable via a clip mechanism 26. The clip mechanism 26 is shown in FIG. 1 attached to the top portion 22. The clip mechanism 26 may be used to adjust the length of the loop formed by the strap 20, by creating a looped portion 20*a* and a tail portion 20*b* of the adjustable strap 20. The looped portion 20*a* may define the effective length of the strap 20, similar to a strap having the same length of the looped portion 20*a*. The tail portion 20*b* may be in the form of excess, and may be effectively non-functional in the fitting of the mask 10 to the user's face. In this manner, the tail portion 20*b* may simply hang down, with the looped portion 20*a* extending around the head and neck of the user such that the looped portion 20*a* is sized to provide the desired fit to the user's face.

The clip mechanism 26 is sized and arranged to be slidable along the length of the adjustable strap 20. In one aspect, the adjustable strap 20 is layered over itself to define an overlap portion of the strap along the tail portion 20*b*. Thus, the clip mechanism 26 extends over twice the thickness of the strap 20. The clip mechanism 26 may be in the form of a closed loop that is flexible such that it can bow outward in response to the double layer of the strap 20 extending therethrough, thereby exerting a reaction force against the layers of the strap 20 to create a pinching, crimping, or clipping frictional force on the strap 20. The clip mechanism 26 may also be in the form of an o-ring or elastic member that exerts an inward force on the strap 20 to hold the adjusted strap 20 in the desired position and with the desired lengths of the looped portion 20*a* and tail portion 20*b*. Accordingly, this pinching, clipping, or crimping force may be utilized to retain the clip mechanism 26 in place along the strap 20 at the location where the clip had been positioned during adjustment of the loop portion 20*a* and tail portion 20*b*.

As described above, the strap 20 includes an upper portion 22 and a lower portion 24. The upper portion 22 and the lower portion 24 are the portions of the strap 20 that are exposed from the mask 10 and that form the loops that may be used to retain the mask 10 on the user. Thus, the lengths of the upper portion 22 and the lower portion 24 are variable relative to the mask 10, whether or not the strap 20 is elastic or adjusted by the clip mechanism 26. Put another way, the upper portion 22 may be lengthened and the lower portion 24 may correspondingly be shortened.

The variable lengths of the upper portion 22 and the lower portion 24 are provided via captured portions 28 of the strap 20. A pair of captured portions 28 of the strap 20 are provided on opposite sides of the mask 10. The captured portions 28 of the strap 20 are the portions that are captured and/or covered by the material of the mask 10. The mask 10 may provide a passageway through which the captured portions 28 are disposed. The captured portions 28 join the upper portion 22 to the lower portion 24 to define a closed loop of the strap 20. The captured portions 28 may be slidable relative to the mask 10 and through the mask material such that a portion of the strap 20 that was captured can be exposed and become part of the upper portion 22 or the lower portion 24, depending on the direction in which the captured portion 28 becomes exposed. Thus, part of the captured portion 28, once exposed, may thereby become part of the upper portion 22 or lower portion 24. When the upper portion 22 is lengthened and the lower portion 24 is reduced, for example, part of the captured portion 28 becomes part of the upper portion 22, and part of the lower portion 24 becomes part of the captured portion 28, in one example. In some instances, the sides of the mask 10 may be bunched up or compressed along the length of the captured portions 28, such that the upper portion 22 and the lower portion 24 may each become longer, with the captured portion 28 becoming shorter. Various other adjustments to the portions that are exposed or covered by the mask material will be understood to be similarly possible. For a given, non-stretched length of the strap 20, the captured portions 28, upper portion 22, and lower portion 24 will combine to define the overall effective length of the strap 20, regardless of the position of the strap 20 relative to the mask, because increases of one section have corresponding decreases of one or more other sections.

Thus, it will be appreciated that a reference to the length of the upper portion 22 or lower portion 24 refers to a length of exposed material of the loop on the upper or lower side of the mask, respectively. Similarly, a reference to a length of the captured portion 28 refers to the length that remains captured and/or covered by the mask, or the length that is not exposed to define the upper/lower portions 22/24.

In one aspect, the mask 10 may define a panel 30 that forms the general shape of the mask 10. The panel 30 may be a multi-layer panel or sheet of one or more materials sufficient for breathability and filtering in accordance with the needs of the user. In one aspect, the panel 30 is made with non-woven fabric, which has better bacteria filtration and air permeability while remaining less slippery than woven cloth. One material that may be used is polypropylene, either 20 or 25 grams per square meter (gsm) in density. Other materials may include polystyrene, polycarbonate, polyethylene, or polyester. In one aspect, woven material may be layered over the non-woven layers. It will be appreciated that different materials and numbers of layers may be used to provide various degrees of filtration and breathability in accordance with the specific needs of the user. The type of material, thickness of material, number of layers of material, and filtration ability of the material may be selected based on various industry standards depending on the intended use of the mask 10. For example, a mask for use in surgical settings may have different requirements than a mask for non-professional or recreational use, and therefore different compositions of the panel 30 of the mask 10 may be used.

The panel 30 may be folded and or stitched to define various structural aspects of the mask 10 and to control the shape of the mask 10 when worn, and the adjustability of the strap 20. In some cases, portions of the mask 10 may be thicker than other portions if the mask 10 is folded or reinforced in some locations, such as locations corresponding to the functionality of the strap 20 of for fitting to the face of the user.

For example, the panel 30 may include a plurality of pleats, or curved seams to define a desired bulbous shape. The panel 30 may include curved outer profiles or cuts to conform to the anticipated shape of the user's face. The panel 30 may be formed of a plurality of layers that conform to surgical standards as determined by the region where the mask 10 is anticipated to be used.

In one aspect, the panel 30 may be folded on each of the sides 12-18. On the right side 16 and the left side 18, the panel 30 may be folded over to define a channel 32. The channel 32 may be open at opposing top and bottom ends, such that the strap 20 will extend through the channels 32, thereby defining the captured portion 28. Thus, the thickness of the mask 10 at the location of the channels 32 may be greater than the middle of the panel 30. The panel 30 may also be folded over at the upper and lower edges 12, 14. The panel 30 may define channels (with openings) along these edges, or the panel 30 may be closed off at opposing left and right sides of these portions. The channels 32 may also be referred to as passageways.

In one aspect, the channels 32 may be reinforced to improved sealing of the mask 10 along the direction of the channels 32. For example, in a rectangular shaped mask, the channels 32 may be reinforced to define opposing sides of the panel 30 that are reinforced to improve sealing along the lateral side edges 14, 16 of the mask 10. Similarly, in other shapes of the mask 10, the channels 32 may also be reinforced to improve sealing along the direction of the channels 32. Reinforcement may be provided by folding the material over itself more than once, or an additional piece of material may be added over the channels 32. In another aspect, additional stitching may be provided to provide reinforcement.

The panel 30 may also be folded over itself in a middle portion of the mask to create laterally extending pleats 34. A stitch may be provided on the right and left sides of the panel 30 to define a generally fixed length along the sides (for example at right and left edges 14, 16) and with the panel 30 folded over (with the crease extending from left to right and an overlap that extends left to right) to define the pleats 34, allowing the panel to expand in the middle portion according to the pleats 34 to create a generally bulbous shape that may fit over the nose and mouth of the user. Put another way, the panel 30 may expand in the middle while remaining generally consistent along the edges due to the pleats 34. Put another way, the perimeter of the panel 30 may remain generally constant, while the surface area of the panel 30 inside the perimeter may increase when the pleats 34 are expanded.

The mask 10 has been described herein as being stitched. However, it will be appreciated that the reference to stitching may refer to various methods similar to stitching in which multiple layers are held together along a seam or similar path. For example, adhesive, welding, melting, or the like may be used to create the stitching or seams described herein.

In one aspect, the mask 10 may further include a nose strip 40 disposed along the upper edge. The nose strip 40 may be embedded within the mask 10 along the upper edge 12. For example, the nose strip 40 may be disposed within a channel or passageway that is defined at the upper edge 12. In one aspect, the nose strip 40 is held in place within the channel or passageway, such that the nose strip 40 does not shift along the length of the upper edge 12 when the length of the nose strip 40 is less than the length of the upper edge 12. The nose strip 40 may be a flexible and plastically deformable material, such as a strip of metal, allowing the user to form and set the curvature of the upper edge 12 of the mask 10 while wearing the mask 10, to thereby conform the upper edge 12 of the mask 10 around the shape of the user's nose and adjacent cheek area.

In one aspect, the mask 10 may further include a chin strip 42 disposed along the lower edge 14. The chin strip 42 may be similar to the nose strip 40, allowing the user to form the lower edge 14 of the mask 10 around the shape of the user's chin. The chin strip 42 may be installed and disposed within the mask in the same manner as the nose strip 40, and the description above regarding the nose strip 40 and chin strip 42 applies equally to the chin strip 42. In one aspect, the nose strip 40 and chin strip 42 may have different lengths relative to the edges of the mask 10 where they are disposed. For example, the nose strip 40 may extend along a portion of the upper edge 12, while the chin strip 42 extends along the entire length of the lower edge 18, or vice versa. The lengths of the strips 40 and 42 may also be the same. It will also be appreciated that the shape of the mask 10 may not be rectangular, and that the lengths of the corresponding edges may not be the same.

The nose strips 40 and 42 may combine with the channels 32 on the side of the mask 10, which may be reinforced, to create a robust sealing perimeter of the mask 10. Such a sealing perimeter of the mask 10 may improve the ability of the mask 10 to limit and/or prevent airflow from outside of the mask 10 to the interior of the mask 10 that would bypass the filtering ability of the panel 30 of the mask 10. The combination of the channels 32 and the adjustable loop 20 as described herein have been found to improve the sealing ability of the mask 10 to pass testing standards for airflow, filtration, and sealing.

Thus, in view of the above, the user may place the mask 10 over the mouth and nose, and adjust the nose strip 40 and chin strip 42. The user may position the lower portion 24 of the strap 20 behind their neck. The user may then adjust the upper portion 22 via the clip mechanism 26 to adjust the length of the loop portion 20*a* and correspondingly adjust the length of the tail portion 20*b*. For example, as the loop portion 20*a* becomes smaller in overall looped length and perimeter and the mask 10 becomes tighter against the user's face, the tail portion 20*b* correspondingly becomes longer. Conversely, as the loop portion 20*a* becomes longer, the tail portion 20*b* becomes shorter. In one aspect, the panel 30 may be adjusted and shaped to comfortably fit the face of the user, and may be generally held in place, with the strap 20 adjusting and sliding relative to the fixed in place panel 30, with portions of the strap 20 being through the channels 32 and the upper and lower portions 22, 24 being adjusted to comfortably fit the neck and head of the user. In this regard, the clip mechanism 26 may be limited to just one of the upper or lower portion 22, 24. In the above description, the upper portion 22 is described as being pulled and adjusted, but the bottom portion 24 may be the portion that is pulled on the by the user with the upper portion 22 correspondingly adjusting.

As shown in FIG. 1, the strap 20 is tied off at the end of the tail portion 20*b*. In another aspect, the strap 20 may be a generally continuous loop without a tied off end portion. In one aspect, the clip mechanism 26 may be disposed on the lower portion 24 of the strap 20 rather than the upper portion 22. In another aspect, the clip mechanism 26 may be disposed on both the upper portion 22 and the lower portion 24 of the strap 20, thereby providing adjustment at both ends. Even with the clip mechanism 26 at both the upper and lower portion 22, 24, the strap 20 can still be adjusted and pulled through the channels 32 from just the upper portion or just the lower portion. With two clip mechanisms, the use may alternate between pulling on the upper and the lower portions 22, 24 and adjusting the positions of the clip mechanism 26 in an iterative manner.

During the tightening of the strap 20 via the clip mechanism 26, the strap 20 may pass through the channels 32 such that the lower portion may be shortened as well as the upper portion in a generally simultaneous manner. In one aspect, the panel 30 of the mask 10 may be placed on the user's face as desired, with slack on the lower portion and upper portion of the strap 20. Tightening the upper portion of the strap 20 via the clip mechanism 26 will tighten both the upper portion and the lower portion, with the strap 20 passing through the channels 32. Thus, both the upper and lower portion 22, 24 can be adjusted by manipulating the clip mechanism 26 on just one of the portions. Similarly, with the clip mechanism 26 disposed on the lower portion, the same adjustment may be made to both the upper and lower portions of the strap 20 by adjusting just one of the portions. Similarly, when two clip mechanisms 26 are provided, one may be left in place and the other may be adjusted to adjust the lengths of both the upper and lower portions of the strap 20.

Figure 2:
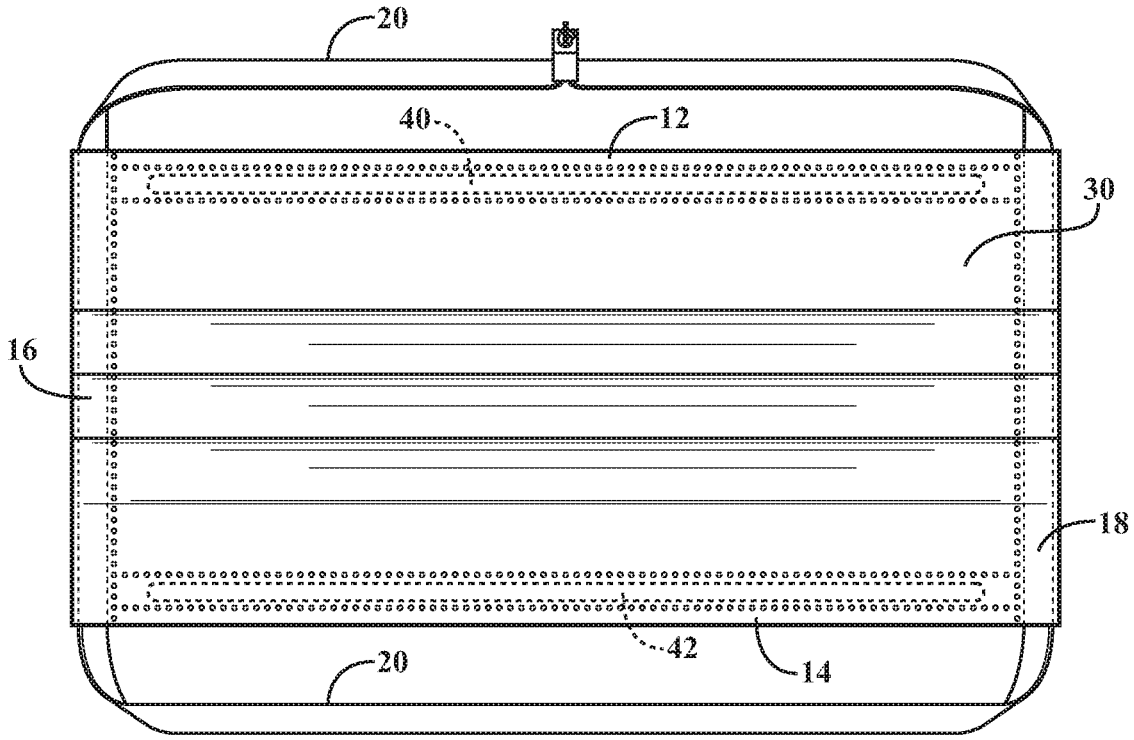
FIG. 2 illustrates a second side of the flexible mask of FIG. 1 according to an aspect of the disclosure.
Figure 3:
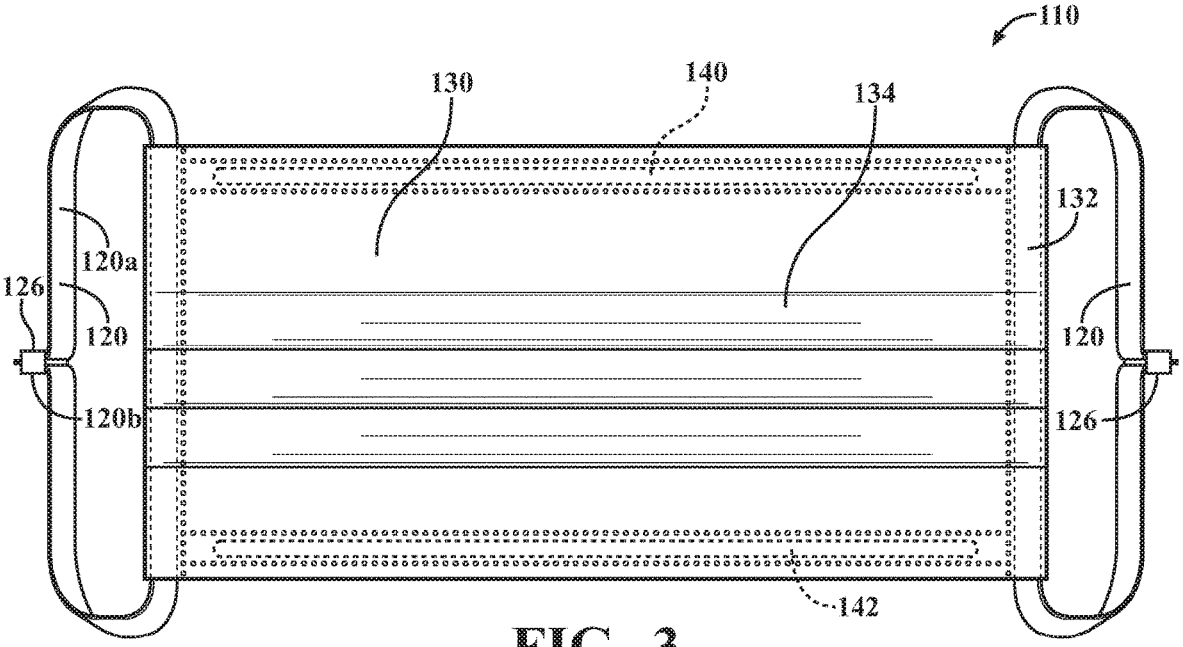
FIG. 3 illustrates a first side of another aspect of a flexible mask having a pair of adjustable straps on the left and right sides of the mask according to an aspect of the disclosure.
Figure 4:
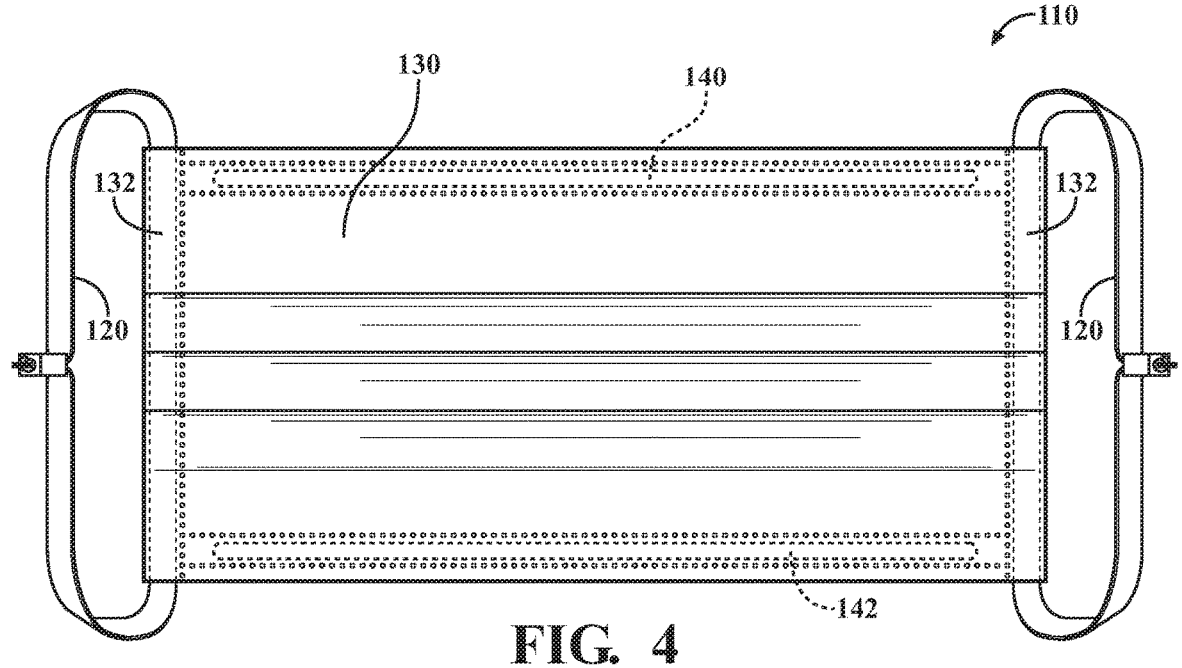
FIG. 4 illustrates second side of the mask of FIG. 3 according to an aspect of the disclosure.

In another aspect, shown in FIGS. 3 and 4, a mask 110 is shown having many of the same features as the mask 10 of FIGS. 1 and 2. The mask 110 differs in that it includes a pair of ear straps 120 on opposite lateral sides of the mask 110. The mask 110 has a similarly constructed panel 130 having pleats 134, channels 132 along the side edges, nose strip 140, and chin strip 142. The features described above for mask 10 are equally applicable to mask 110 unless otherwise noted. For example, the strap 20 and 120, and the adjustment thereof, differs between mask 10 and 110.

The ear straps 120 may each include a clip mechanism 126 that is slidably adjustable to adjust the length of a looped portion 120*a* and a tail portion 120*b*. Thus, the ear straps 120 may be easily adjusted to provide a comfortable fit around the back of the ear on both sides of the user's face, accommodating non-symmetrical facial features and the like without undue elastic pressure on one or both ears. Thus, the effective length of the strap 120 on the left side may be adjusted to be less than the adjusted length of the strap 120 on the right side, while allowing the mask 110 to be centrally and comfortably placed on the user's face.

Similar to the mask 10, with the mask 110 placed on a user's face, and with the nose strip 140 and the chin strip 142 adjusted to a desired shape, each of the ear loops 120 may be adjusted via the clip mechanism 126 in an efficient manner to securely hold the mask 110 on the user's face. The mask 110 can be removed easily by subsequently adjusting the clip mechanism 126. In the case of the ear straps 120 being elastic, the ear straps may be stretched to remove the mask 110. The use of the clip mechanism 126 to adjust the length allows for easy placement of the mask 110 on various shapes and sizes of user faces without necessarily requiring elastic to keep the mask in place, and without requiring cumbersome knots or the like. However, elastic may be still be used and may provide additional flexibility.

In the case of elastic straps 20 or 120, after adjusting and setting the clip mechanism 26, 126 in a desired position, the clip mechanism 26, 126 may be "locked" or otherwise secured in place on the strap 20, 120. Following the determination of an ideal position, the straps 20, 120 may be removed from the user and subsequently re-attached to the user while maintaining the previously determined lengths, with minimal subsequent adjustment to be performed when the clip mechanism 126 are left in place.

The straps 120 may extend through the channels 132 such that the straps 120 may slide relative to the mask 110. Thus, the clip mechanisms 126 may be moved from the top side of the loop above the ear to the bottom side of the loop below the ear, or behind the ear. Additionally, the sides of the mask along the channels 132 may bunch up to conform to the shape of the user's face while maintaining the same effective length of the straps 120.

Figure 5:
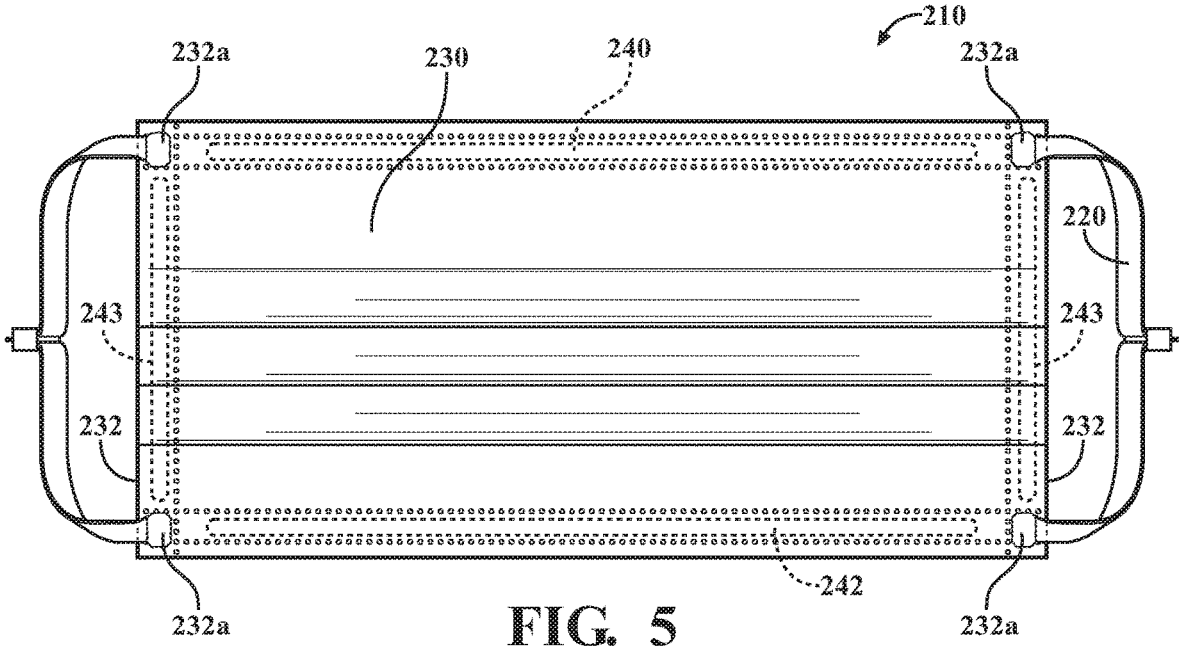
FIG. 5 illustrates a first side of another aspect of a flexible mask having a pair of adjustable straps on the left and right sides and including bendable strips on the left and right sides according to an aspect of the disclosure.
Figure 6:
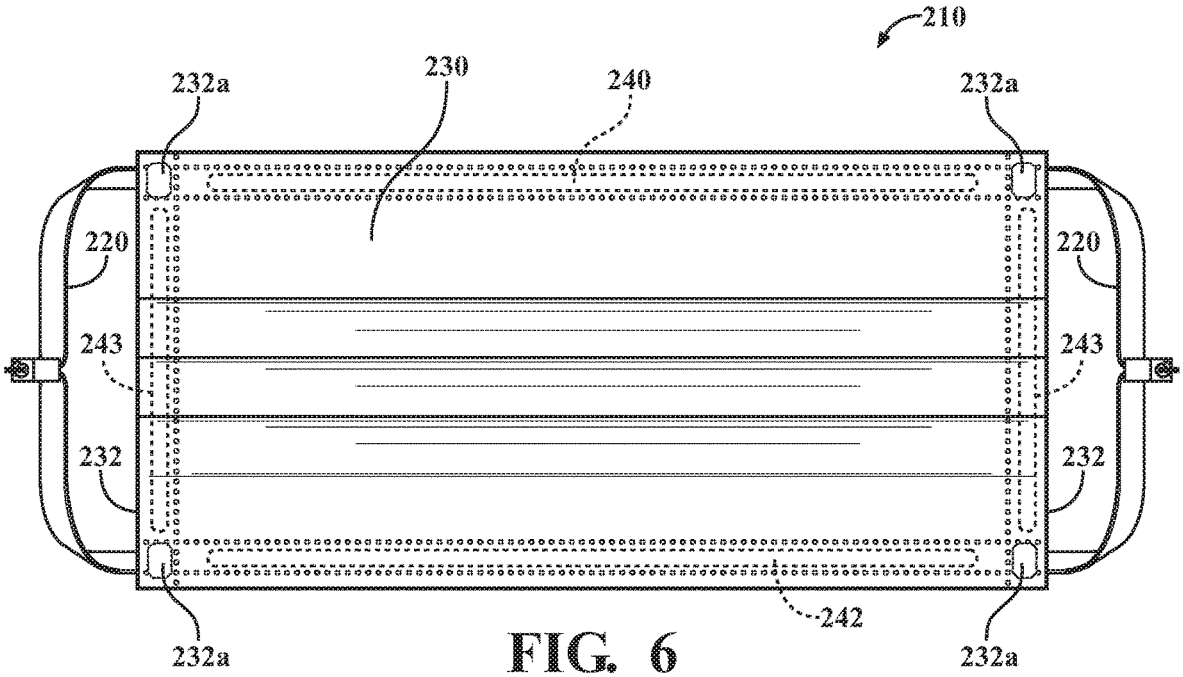
FIG. 6 illustrates a second side of the flexible mask of FIG. 5 according to an aspect of the disclosure.

With reference to FIGS. 5 and 6, another aspect of a flexible mask 210 is shown. FIGS. 5 and 6 illustrate opposite sides (front and back) of the mask 210. The mask 210, similar to the mask 10 and 110, may include a nose strip 240 and a chin strip 242 that are embedded within panel 230. The features of the mask 10/110 and panel 30/130 described above may also apply to the mask 210 and panel 230, unless otherwise noted. For example, straps 240 operate differently.

Mask 210 includes left and right sides side channels 232. Like channels 32 and 132, channels 232 may be reinforced with the panel material being folded over, as shown in FIG. 6. However, it will be appreciated that the channels 232 may also be formed in other ways. Channels 232 of mask 210 may differ from channels 32 and 132, in that channels 232 may be closed at opposite top and bottom ends. Channels 232 may be closed by an adhesive, melted, or welded portion of the material of the channel 232, as shown by closure points 232*a* in FIG. 6, which are shown in the form of dots, similar to a spot welding operation. With channels 232 being closed, the channels 232 do not generally operate as a passageway for the strap 240, but still provide an interior space. The closure points 232*a* may also be created by sonic welding, glue, etc.

Mask 210 is illustrated with left and right straps 220, which are shown in the form of ear straps with adjustable clips 226. Thus, the left strap 220 is arranged to be placed over and around the left ear, and the right strap 220 is arranged to be placed over and around the right ear. In the case of ear straps, the straps 220 do not typically extend across the back of the user's neck and/or head. The straps 220 may be a flexible elastic type of material or may be a fixed length material. The ends of the straps 220 may be fixed to mask 210 at closure points 232*a* via sonic welding, glue, etc. thereby fixing the ends of the straps 220 relative to the panel 230. Put another way, the straps 220 generally do not shift along or through the material of the mask 210, with the adjustment generally occurring outside of the panel 230.

The channels 232 may each include an embedded cheek strip 243. The check strip 243 may be in the form of a bendable metal wire, strip, or the like, sized and arranged to be bent to conform to the shape of the face/cheeks of the user, similar to the nose clip 240 and chin clip 242. The cheek strips 243 may have a length that corresponds to the lengths of the edges of the panel 230, or the length of the cheek strep 243 may be smaller. The cheek strip 243 may be held in place within the channel 232.

Figure 7:
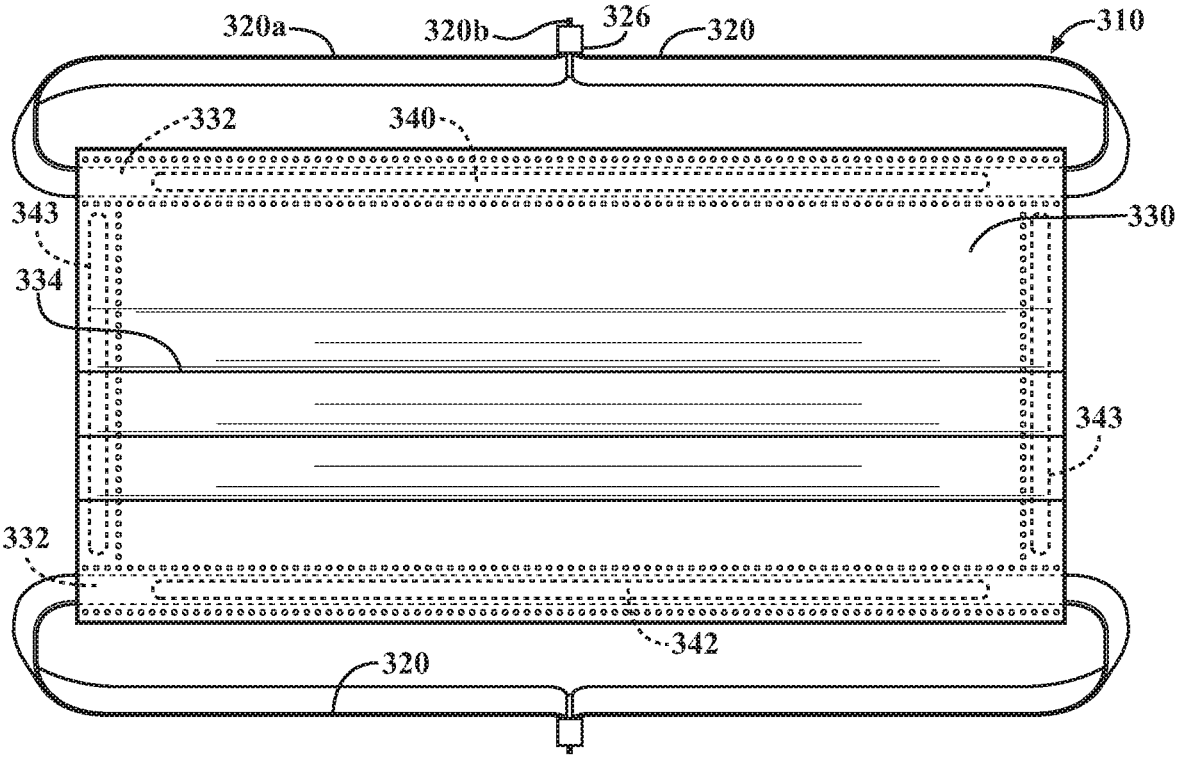
FIG. 7 illustrates a first side of another aspect of a flexible mask having a pair of adjustable straps on the top and bottom sides with through channels extending along the top and bottom edges.
Figure 8:
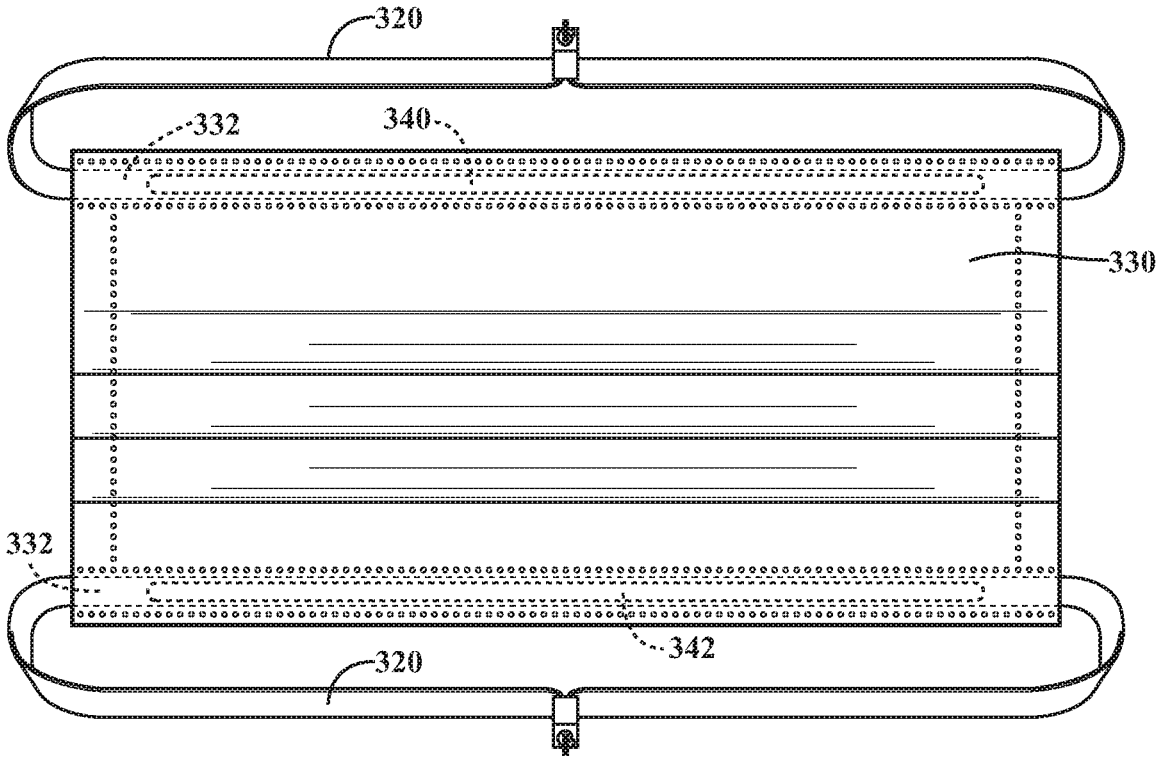
FIG. 8 illustrates a second side of the flexible mask of FIG. 7 according to an aspect of the disclosure.

In another aspect, shown in FIGS. 7 and 8, a mask 310 is shown having many of the same features as the masks 10 and 110 of FIGS. 1-4. The mask 310 differs in that it includes a pair of channels 332 extending laterally across the top and bottom edges of the mask 310, rather than extending up and down along the opposite side edges as in masks 10 and 110.

Similar to the above described masks, mask 310 includes a panel portion 330 having a plurality of pleats 334 that allow the mask 310 to transition from a flat arrangement to a curved arrangement to accommodate the shape of a user's face, such as the user's nose and mouth.

The mask 310 includes straps 320 that are arranged to define a closed loop for extending behind the neck and behind the back of the head, similar to the strap arrangement of FIG. 1. Unlike the strap arrangement of FIG. 1, the mask 310 may include two separate straps 320 that are adjustable independent of each other. Put another way, stretching or adjusting the length of upper strap 320 will not substantially affect the length of the lower strap 320, aside from any residual changes that may occur as the fit of the mask 310 on the user's face adjusts. The straps 320 may be elastic and stretchable, in one aspect, or they may be non-elastic. The straps 320 may include clips 326, in one aspect, to adjust the length of the strap that defines the loop around the user's head/neck. Adjustment of the clip 326 may adjust the length of loop portion 320*a* relative to tail portion 320*b*.

The straps 320 are on opposite vertical sides of the mask 310. The mask 110 has a similarly constructed panel 330 having pleats 334, a nose strip 340, and a chin strip 342. The mask may further include cheek strips 343, similar to the cheek strips 243 described above. The nose strip 340, chin strip 342, and cheek strips 343, like the strips mentioned previously, may be metallic and plastically deformable to conform to the specific shape and curvature of the user's face. In one aspect, strips 340, 342, 343 are disposed along each of the edges of the mask 310. In another aspect, strips may be excluded from the cheek area and the lateral sides of the mask, or the chin strip 342 may be excluded. In one aspect, strips 340, 342, 343, which may be referred to as upper and lower strips and left-side and right-side cheek strips, respectively, are plastically deformable bendable strips and are disposed continuously along a majority of an entire length and through a midpoint of the upper, lower, right, and left edges of the panel as shown in FIGS. 7-8. In one aspect, as shown in FIGS. 7-8, left-side cheek strip 343 is disposed first channel along the left side of the panel 330 and extends continuously along a majority of an entire length of the left edge and through a midpoint of the left edge, and right-side cheek strip 343 is disposed along a right side of the panel 330 and extends continuously along a majority of an entire length of the right edge and through a midpoint of the right edge. As shown in FIGS. 7 and 8, the straps 320 extend through the upper and lower channels 332 and are adjustable and moveable through the upper and lower channels 332, and upper and lower strips 340, 342 extend along the upper and lower channels.

The straps 320 are slidable, moveable, and/or shiftable relative to the mask 310 via the channels 332. By allowing the straps 320 to shift relative to the mask 310 in this aspect, the straps 320 may be adjusted, via stretching or via length adjustment, with the mask 310 remaining generally in place on a user's face.

The use of straps 320 extending through upper and lower channels 332 in this aspect further provides for an improved seal across the corresponding region of the face, including over the nose and under the chin. The force applied by the straps 320 on the mask 310 and against the face can therefore be directed to these areas of the face for an improved seal.

In the case of the nose strip 340 and chin strip 342 which are disposed along the same section as the channels 332, the strips 340 and 342 may be embedded in the material of the mask 310 or in a separate enclosed channel, such that the straps 320 may slide through the channels 332 without contacting or being restricted by the strips 340, 342. The strips 340, 342 may be disposed either above or below the through-channels 332.

Figure 9:
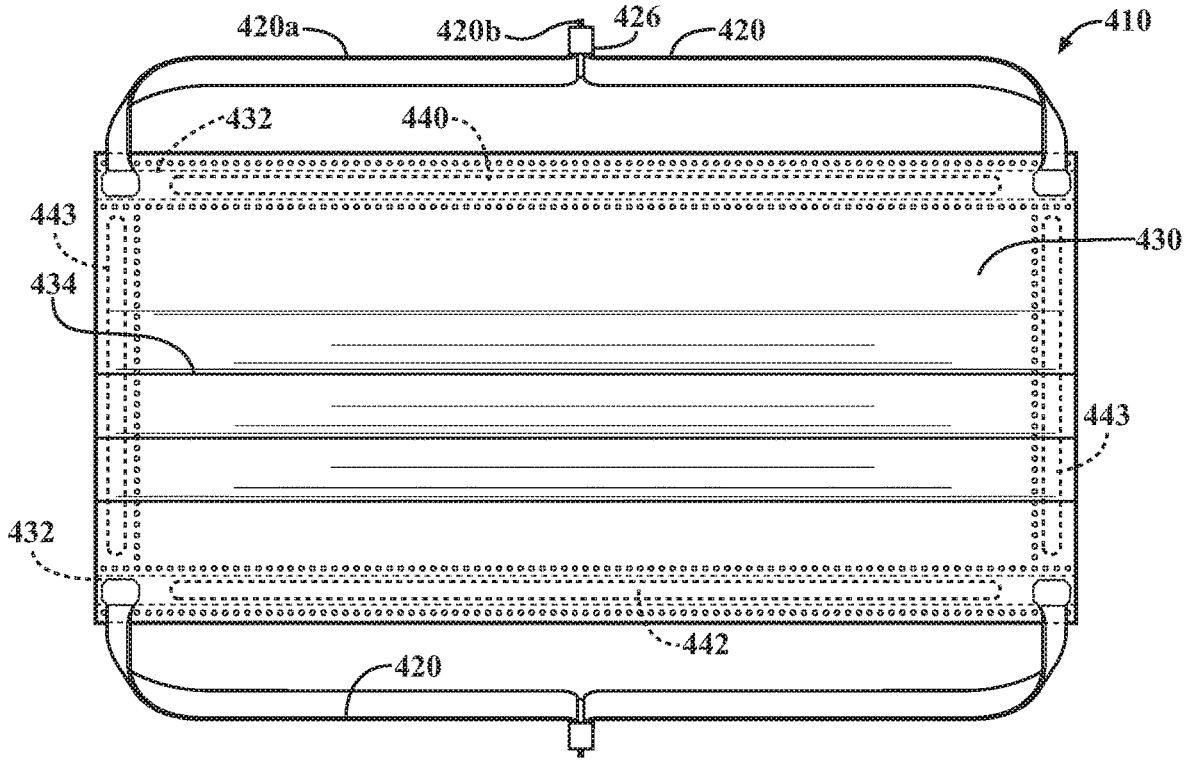
FIG. 9 illustrates a first side of another aspect of a flexible mask having a pair of adjustable straps on the top and bottom sides with ends fixed to the mask.
Figure 10:
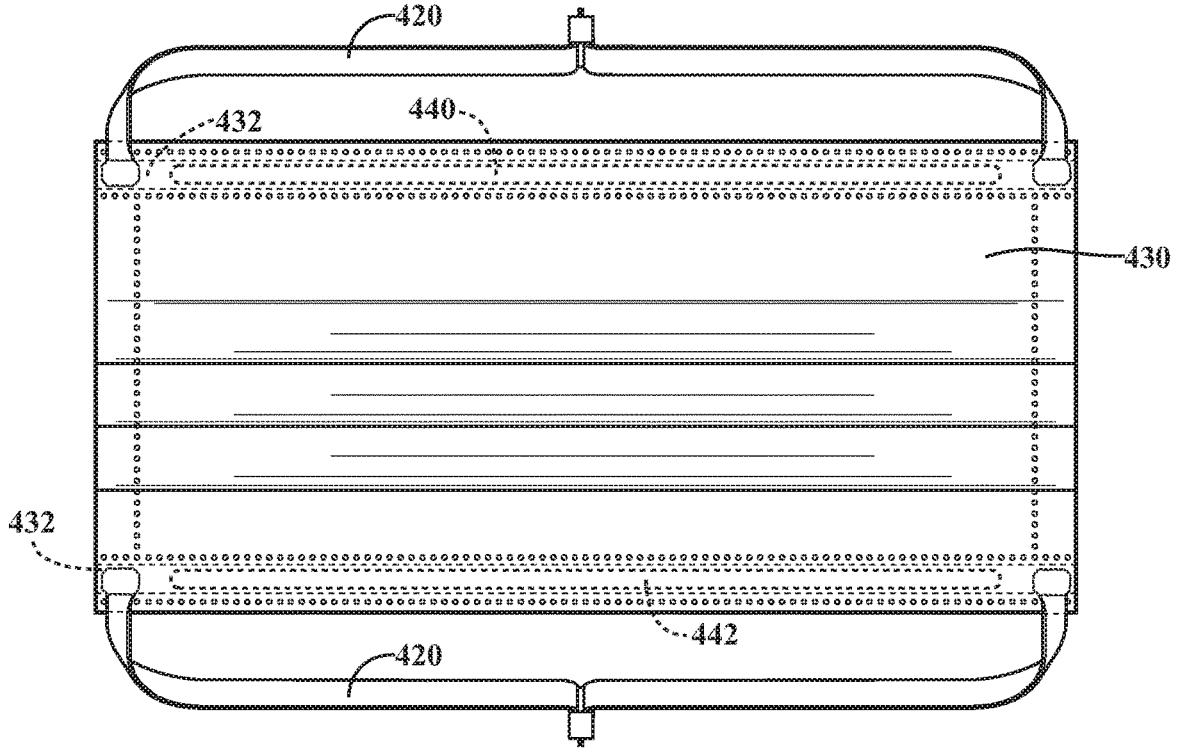
FIG. 10 illustrates a second side of the flexible mask of FIG. 9 according to an aspect of the disclosure.

With reference to FIGS. 9 and 10, another aspect of a flexible mask 410 is shown. FIGS. 9 and 10 illustrate opposite sides (front and back) of the mask 410. The mask 410, similar to the masks described above, may include a nose strip 440 and a chin strip 442 that are embedded within panel 430. The features of the masks and panels described above may also apply to the mask 410 and panel 430, unless otherwise noted.

Mask 410 may include left and right sides side channels 432 and similar top and bottom channels 432. Like previously described channels, channels 432 may be reinforced with the panel material being folded over. However, it will be appreciated that the channels 432 may also be formed in other ways. Channels 432 of mask 410 may differ from channels 32, 132, and 332 in that channels 432 may be closed at opposite top and bottom ends, similar to channels 232. Channels 432 may be closed by an adhesive, melted, or welded portion of the material of the channel 432, as shown by closure points 432*a* in FIG. 10, which are shown in the form of dots, similar to a spot welding operation. With channels 432 being closed, the channels 432 do not generally operate as a passageway for the straps 420, but still provide an interior space. The closure points 432*a* may also be created by sonic welding, glue, etc.

Mask 410 is illustrated with top and bottom straps 420, which are shown in the form of head and neck straps with an optional adjustable clip 426 (with straps 420 include portions 420*a* and 420*b* that are adjustable in response to adjustment of clip 426). Thus, the top strap 420 is arranged to be placed behind the neck, and the bottom strap 420 is arranged to be placed around the neck. The straps 420 may be a flexible elastic type of material or may be a fixed length material. The ends of the straps 420 may be fixed to mask 410 at closure points 432*a*, via sonic welding, glue, etc. thereby fixing the ends of the straps 420 relative to the panel 230. Put another way, the straps 420 generally do not shift along or through the material of the mask 410, with the adjustment generally occurring outside of the panel 430. The straps 420, being fixed at their ends and at opposite sides of the mask, may therefore be separate, such that adjustment of one does not cause adjustment of the opposite strap.

The channels 432 on the side may each include an embedded cheek strip 443. The check strip 443 may be in the form of a bendable metal wire, strip, or the like, sized and arranged to be bent to conform to the shape of the face/cheeks of the user, similar to the nose clip 440 and chin clip 442. The cheek strips 443 may have a length that corresponds to the lengths of the edges of the panel 430, or the length of the cheek strep 443 may be smaller. The cheek strip 443 may be held in place within the channel 432.

It will appreciated that in some aspects, not all of the nose, chin, and cheek strips may be used. For example, the mask 410 may include the nose and chin strips 440, 442, but not the cheek strips 432.

The above described aspects of the various embodiments of masks 10, 110, 210, 310, 410 may be used with different embodiments. For example, the cheek strips 243, 443 may be used with mask 10 or 110 (or 310). In such an example, the cheek strips 243, 443 may be embedded in the material of the channels 32, 132 such that the straps 20, 120 may still slide or shift along the channel 32/132 without coming in contact with the cheek strip 243, 443.

In each of the above masks 10, 110, 210, 310, 410 the nose, chin, and cheek strips may have different lengths. For example, the nose strips may be shorter than the chin strips. The cheek strips on each side may have the same length as each other, but may be shorter than both the nose strip and chin strip.

As described previously, the masks 10, 110, 210, 310, 410 need not necessarily be rectangular in shape, and the masks may therefore have various non-rectangular shapes. The above described aspects, such as the straps and various embedded strips may be used in a similar manner for non-rectangular shapes, providing face-conforming shapes and curvature to the perimeter of the mask 10, 110, 210, 310, 410.

In each of the above described embodiments, the masks 10, 110, 210, 310, 410 have been illustrated in the form of surgical masks. Surgical masks provide air filtering abilities such that air may be inhaled and exhaled therethrough while trapping small particles, such as those related to viruses and the like. The above described aspects may also be applied to cloth masks that are not considered surgical grade but still provide benefits in reducing disease transmission by blocking respiratory droplets or aerosols. Providing a snug fit around the perimeter of the mask 10/110/210/310/410 while allowing for breathability can limit respiratory droplets from exiting the masks from the top, bottom, or side of the mask. The adjustable straps 20/120/220/320/420 and bendable strips described above improve the fit of the flexible mask 10/110/210/310/410 on the face of the user and improve the snugness of the fit while remaining comfortable of the user.

The materials of the masks 10/110/210/310/410 can accordingly vary depending on the specific needs of the user. The materials of the masks 10/110/210/310/410 may be various known layers to provide the desired filtration. The features of the masks 10/110/210/310/410 described herein may provide substantial benefits in a surgical or medical setting. Many flexible masks suffer from poor sealing along the sides, causing a bulge outward and creating an opening on the sides when tightened. The above described aspects limit such occurrences, and provide enhanced sealing along the side portions, in addition to the top and bottom portions. For example, when the straps 20/120/320 extend through the channels 32/132/332, even a tendency for the edge of the mask 10/110/310 to bunch up along the edges may be counteracted by strap 20/120/320 that extends through the channel 32/132. When the bunching occurs, the material of the mask 10/110/310 may simply follow the contour of the strap 20/120/320, which remains against the cheek of the user, such that a substantial opening at the edge does not occur. In prior art flexible masks without channels, when the sides bunch up, the edges tend to fold over and create an open space at the sides, even when other edge areas may be sealed. While the mask 210/410 described above does not include the strap 220/420 extending through side channels, the mask 210/410 may include the cheek strips 243/443 that counteract bunching on the sides and provide a snug and conforming fit to the user's face. In one aspect the use of strips as well as slidable or shiftable straps may combine to improve sealing and reduce bunching.

The flexible nature of the masks, unlike rigid shell-type masks, provides for a mask that can fit a variety of face shapes, with the various face shapes being accommodated by the masks flexing and the associated straps and strips providing a snug fit with good sealing performance. The flexible masks of the present disclosure are lightweight and comfortable to wear, and can lay flat before and after use, thereby reducing storage space, shipping cost, and the like. The masks of the present disclosure provide improved sealing capable of satisfying strict standards while remaining flexible and lightweight and easy to wear.

The various through-channels described above, through which the straps may move/shift/slide, extend generally along the entire length of the edge of the mask, whether the channels are on the side edges or the top/bottom edges. Accordingly, the force applied to the masks by the straps and correspondingly applied to the face is distributed along substantially the entire length of the edges where the channels are disposed. This arrangement can provide improved sealing along said edges.

Thus, in view of the above, various aspects of the disclosure may be used to provide a comfortable and secure fit of the mask 10/110/210/310/410 on a user's face.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A facial covering arranged to be placed over a user's nose and mouth, the facial covering comprising:

a flexible panel defining a mask and having a rectangular shape and upper, lower, right, and left edges;

a pair of channels defined in opposite edges of the flexible panel, the channels each being open at opposing ends of a respective channel of the pair of channels and each defining a continuous passageway between the opposing ends of the respective channel of the pair of channels, wherein the opposite edges are the upper and lower edges;

a pair of adjustable straps respectively extending through the pair of channels;

wherein the adjustable straps are moveable through the channels; and at least one plastically deformable bendable strip portion disposed continuously along a majority of an entire length and through a midpoint of at least one edge of the upper, lower, right, and left edges, wherein the at least one edge along which the at least one bendable strip portion is disposed includes the left and right edges.

2. The facial covering of claim 1, wherein the adjustable straps each include a clip mechanism that is adjustable along a corresponding adjustable strap of the adjustable straps to adjust a first length of a looped portion that defines a closed loop and to adjust a tail portion that defines a closed loop having a second length, wherein, in response to movement of the clip mechanism, the first length increases when the second length decreases and the second length increases when the first length decreases.

3. The facial covering of claim 1, wherein the adjustable straps comprise an upper strap and a lower strap each extending through a corresponding channel of the pair of channels disposed at the upper and lower edges, wherein the upper strap and lower strap are adjustable independent of each other.

4. The facial covering of claim 1, wherein the at least one plastically deformable bendable strip portion is embedded within at least one of an upper edge portion of the panel, a lower edge portion of the panel, a left edge portion of the panel, or a right edge portion of the panel.

5. The facial covering of claim 1, wherein the channels extend more than 50% of a length defined by terminal points of each of the opposite edges along the edges of the flexible panel.

6. The facial covering of claim 1, wherein the channels are reinforced to improve sealing therealong.

7. The facial covering of claim 1, wherein a length of the opposite edges of the panel are reduceable via bunching of the pair of channels along the at least one adjustable strap while maintaining a length of the at least one adjustable strap.

8. A facial covering arranged to be placed over a user's nose and mouth, the facial covering comprising:

a flexible panel defining a mask and having a flat rectangular shape formed by multiple layers of flexible material and a pair of channels defined in opposite first and second edges of the panel;

a pair of straps, which are separate from all of the multiple layers forming the flat rectangular shape, extending from the panel and arranged to attach to a user's head and/or neck; and a bendable strip disposed along each of the channels, the bendable strip sized and arranged to be adjustably bent to conform to a shape of a user's face;

wherein the straps are adjustable and moveable through the channels.

9. The facial covering of claim 8, wherein the bendable strip disposed along each of the channels comprises a bendable nose strip disposed on an upper side of the panel and a bendable chin strip disposed on a lower side of the panel.

10. The facial covering of claim 8, wherein the straps each include a looped portion and a tail portion and an adjustable clip slidable along a corresponding strap of the pair of straps to alter relative lengths of the looped portion and the tail portion.

11. The facial covering of claim 8, wherein the channels are reinforced by a material of the panel.

12. The facial covering of claim 8, wherein the bendable strip disposed along each of the channels defines upper and lower strips disposed on an upper portion of the panel and a lower portion of the panel.

13. The facial covering of claim 12, wherein the facial covering further comprises right and left bendable strips disposed on a right side of the panel and a left side of the panel respectively.

14. The facial covering of claim 9, wherein the pair of straps comprise an upper loop portion and a lower loop portion extending from upper and lower portions of the panel, respectively.

15. The facial covering of claim 8, wherein the pair of straps comprise first and second loop portions extending from the opposite first and second edges of the panel, wherein the bendable strip disposed along each of the channels defines first and second bendable strips respectively disposed along the pair of channels defined in the opposite first and second edges of the panel, and third and fourth bendable strips are respectively disposed along opposite third and fourth edges of the panel that are different than the first and second edges.

16. The facial covering of claim 15, wherein the first and second edges are upper and lower edges, and the third and fourth edges are left and right edges.

17. The facial covering of claim 8, wherein the flexible panel has four corners and left, right, upper, and lower edges, wherein the pair of channels defined in the opposite first and second edges of the panel comprise upper and lower channels wherein the left and right edges are on opposite third and fourth edges of the panel, a left-side bendable strip extending continuously along a majority of an entire length of the left edge and through a midpoint of the left edge, a right-side bendable strip extending continuously along a majority of an entire length of the right edge and through a midpoint of the right edge, a first strap of the pair of straps extending from a first pair of the four corners of the panel and forming a first closed loop along with the upper edge, a second strap of the pair of straps extending from a second pair of the four corners of the panel and forming a second closed loop along with the lower edge, and wherein the first and second straps are adjustable and moveable through the upper and lower channels, respectively.

* * * * *